US005660239A

United States Patent [19]

Mueller

[11] Patent Number: 5,660,239

[45] Date of Patent: Aug. 26, 1997

[54] DRAG ANALYSIS METHOD

[75] Inventor: Mark D. Mueller, Santa Maria, Calif.

[73] Assignee: Union Oil Company of California, El Segundo, Calif.

[21] Appl. No.: 127,889

[22] Filed: Sep. 27, 1993

Related U.S. Application Data

[63] Continuation of Ser. No. 560,380, Jul. 31, 1990, abandoned, which is a continuation-in-part of Ser. No. 486,312, Feb. 28, 1990, abandoned, and Ser. No. 401,086, Aug. 31, 1989, Pat. No. 4,986,361.

[51] Int. Cl.[6] ..... E21B 7/04

[52] U.S. Cl. ..... 175/61; 175/57

[58] Field of Search ..... 175/40, 61, 57; 73/151; 364/578, 420, 422

[56] References Cited

U.S. PATENT DOCUMENTS

| | | | |
|---|---|---|---|
| 4,123,367 | 10/1978 | Dodd | 252/8.58 |
| 4,251,773 | 2/1981 | Cailliau et al. | 324/347 |
| 4,256,191 | 3/1981 | Jones | 175/93 |
| 4,346,594 | 8/1982 | Owings | 73/155 |
| 4,384,483 | 5/1983 | Dellinger et al. | 73/151 |
| 4,396,211 | 8/1983 | McStravick et al. | 285/47 |
| 4,428,441 | 1/1984 | Dellinger | 175/61 |
| 4,484,641 | 11/1984 | Dismukes | 175/61 |
| 4,658,901 | 4/1987 | Alexander | 166/301 |
| 4,665,996 | 5/1987 | Foroulis | 175/61 |
| 4,683,955 | 8/1987 | Stepp et al. | 166/327 |
| 4,685,329 | 8/1987 | Burgess | 73/151 |
| 4,695,957 | 9/1987 | Peltier | 175/40 X |
| 4,715,452 | 12/1987 | Sheppard | 175/61 |
| 4,760,735 | 8/1988 | Sheppard et al. | 73/151 |
| 4,791,998 | 12/1988 | Hempkins et al. | 175/61 |
| 4,794,534 | 12/1988 | Millheim | 175/40 X |
| 4,848,144 | 7/1989 | Ho | 73/151 |
| 4,852,399 | 8/1989 | Falconer | 175/39 X |
| 4,986,361 | 1/1991 | Mueller et al. | 166/381 |

FOREIGN PATENT DOCUMENTS

| | | |
|---|---|---|
| 0186317 | 7/1986 | European Pat. Off. . |
| 263644 | 4/1988 | European Pat. Off. . |
| 3021558 | 1/1982 | Germany . |

OTHER PUBLICATIONS

"Field Comparison of 2–D and 3–D Methods for the Borehole Friction Evaluation Directional Wells," by Maidla and Wojtanowicz, Society of Petroleum Engineers, #SPE 16663, 1987.

"Uses and Limitations of a Drilling String Tension and Torque Model to Monitor Hole Conditions," by Brett et al., SPE #16664, 1987.

"Torque and Drag in Directional Wells–Prediction and Analysis," by Johancsik, Friesen and Dawson, Society of Petroleum Engineers/International Association of Drilling Contractors, 1983.

"Extended Reach Drilling From Platform Irene", by Mueller et al. OTC # 6224, Presented at 22nd Annual Offshore Technology Conference, May 7–10, 1990.

*Primary Examiner*—Hoang C. Dang

*Attorney, Agent, or Firm*—William O. Jacobson; Gregory F. Wirzbicki

[57] ABSTRACT

An iterative planning and monitoring method for drilling (and completing) difficult boreholes which avoids unnecessary risk or cost. The method provides multiple point value probability estimates of an indicator of drilling problems based upon a range of possible drilling variables, supplanting single point estimates. Expected drilling variables are perturbed within physically feasible bounds, and multiple estimates of the corresponding indicator values are made. The probability of each estimate is used to calculate the likelihood of an indicator of an unwanted condition. Mitigation measures are implemented if the probability of an unwanted condition exceeding a threshold value is unacceptable and the mitigated probability is reassessed. If the perturbed indicator change is not significant, the drilling variable is deleted from further analysis. Critical variables are thus quickly identified, allowing monitoring and selection of mitigation measures which are the most cost effective. Unnecessary mitigation procedures or unwanted drilling risks are avoided by these procedures.

22 Claims, 3 Drawing Sheets

DRAG ANALYSIS METHOD

CLAIM OF PRIORITY

This application is a continuation of application Ser. No. 07/560,380 filed Jul. 31, 1990 now abandoned, which is a continuation in part of U.S. application Ser. No. 07/486,312 filed on Feb. 28, 1990 now abandoned and U.S. application Ser. No. 07/401,086 filed on Aug. 31 1989, now U.S. Pat. No. 4,986,361. The teachings of these prior filed applications are incorporated in their entirety herein by reference.

FIELD OF THE INVENTION

This invention relates to well drilling methods and apparatus to control well drilling methods. More specifically, the invention provides a method which reduces the risk of stuck tubulars during the drilling and completion of extended reach wells.

BACKGROUND OF THE INVENTION

Many subsurface natural resources, such as oil bearing formations, can no longer be exploited by drilling wells having vertical boreholes from the surface. Extended reach wells, such as wells drilled from platforms or "islands" and having long non-vertical or inclined portions, are now common. The inclined portion is typically located below an initial (top) nearly vertical portion. The deviated portion may have an inclined angle from the vertical that may approach 90 degrees (i.e., nearly horizontal). The result is a well bottom laterally offset from the top by a significant distance.

Current technology can produce boreholes at almost any incline angle, but current drilling (including completion) methods have experienced problems in long, highly deviated well bores. For example, running casing into some highly deviated holes can result in significantly increased drag forces (i.e., a high drag borehole). This can result in a stuck casing pipe string before reaching the desired setting depth of the casing. If sufficient additional force (up or down) cannot be applied to free the stuck casing, the result may be the effective loss of the well. Even if a stuck string is avoided or freed, the forces needed to overcome high drag may cause serious damage to the pipe.

In order to avoid unwanted drilling problems, indicators of these problems are predicted and/or monitored. For example, the lifting force (i.e., supported or indicator weight) required to support the weight of a casing string is not equal to the actual weight of the casing string in part because of drag forces in the borehole which (if large enough) can cause a stuck casing. The excess of actual weight compared to indicator weight (force required to support the casing) during running into a wellbore is an indicator of drag and the potential for a stuck casing. Other widely used drag related indicators include drilling speed and torque applied during rotary drilling. Other problems, some of which may be accentuated by highly deviated wells, include lost circulation, structural failure of the drill string, misdirection, cement failure, vapor/low density material segregation and pockets, and hole cleaning. Still other indicators for these and other problems during drilling include: mud return rate, density and temperature; mud pump pressure; well surveys; applied torque; cutting speed; string weight; and quantity of cuttings recovered.

Options to mitigate the risk of these problems are available, if indicated to be required. For example, high drag mitigation methods can either 1) add downward force or 2) reduce the coefficient of friction, e.g., by lubrication or conditioning of the borehole.

However, these mitigation options are generally costly and of limited effectiveness. For example, only a limited added downward force can be exerted on the pipe string. Excessive downward force beyond safe limits tends to buckle the string, adding still further drag forces (if laterally supported in a highly deviated well bore) or causing structural failure (if laterally unsupported). In addition, drilling with large added downward forces may be impractical or rig/tubular pick up weight limits may be exceeded.

Similar limits affect current coefficient of friction reducing (i.e., lubricating, hole conditioning, or drag reducing) methods. As longer lubricated pipe strings are run into an extended reach well, even a lubricated string will eventually generate unacceptable drag forces because friction is only reduced, not eliminated. The geometry and borehole wall (i.e., interface surface) conditions of some holes may also create increased resistance (high drag) conditions even with lubricated strings in shorter inclined vertical hole portions.

Many drilling variables and other factors which may significantly affect the drilling process can change drastically during the drilling or running of tubulars (i.e., casing running or tripping) and related operations. For example, drag forces at any instant of time may be calculated from actual torque and supported weight data indicators, but both can change quickly. These indicators are dependent upon many drilling (including formation) variables or other factors. Although some variables are relatively constant and known (such as pipe section stiffness), others (such as friction factor) can change quickly and are uncertain. These uncertain and changeable variables and factors also include borehole cross-sectional geometry, drill string ledge contacts, key seat effects, cutting bed properties, differential pressure effects, slant angle, contact surface, hydrodynamic viscous drag, bit balling, mud solids content and dog leg severity conditions.

Basic predictive analysis methods are used to plan a drilling program which is acceptable, i.e., likely to be successful. Expected drilling variable data are used in a model to predict a single likely value of each indicator of an unwanted condition. If some of the predicted values (during drilling) of an indicator (such as indicator weight) fall outside an acceptable or "normal" threshold, corrective or mitigation measures are planned and/or implemented. If mitigation measure is planned/implemented, a second prediction of the single likely value of each indicator using mitigated drilling variable values may be made to verify that the predicted value of each indicator is now acceptable.

Basic monitoring type techniques obtain drilling indicator (as well as some drilling variable) data during drilling (and completion) operations and compare these actual or real time monitored values to expected or threshold values. If a threshold value is exceeded or actual data are outside a "normal" range, the operator is warned of the danger so that other drilling method (mitigation measures) can be employed. One can also combine prediction and monitoring methods on an incremental basis, e.g., a different method for each zone or formation of interest.

A statistical approach, as described in U.S. Pat. No. 4,791,998, is also known. It first requires grouping of drilling data (i.e., indicator data and other factors) from a first set of similar wells that displayed an unwanted condition, e.g., a stuck pipe string. A second set of drilling data from another statistically significant group of similar wells that did not display the unwanted condition is also required. The method statistically analyzes drilling variables for a new well of interest with respect to these two prior data sets and predicts which group the well of interest is expected to fall into. If an unwanted condition is expected, mitigation measures are implemented to change the drilling variables towards values approaching the second set.

These methods have led to three types of drilling approaches, all three of which may result in excessive cost because of the inability to economically handle the inherent uncertain and variable factors such as downhole conditions. The first type, or excessively conservative approach, employs unnecessary mitigation measures to avoid problems which probably would not have occurred (i.e., the conservative threshold values for indicators signal potential problems along with false alarms and mitigation measures are frequently employed). Unless a significant risk of a problem occurring exists, employing a mitigation measure is not cost effective.

Unnecessary delay/failure to employ an effective or correct mitigation measure when needed is the sometime catastrophic result of an excessively risky second approach which ignores a significant chance of the unwanted condition (i.e., the threshold indicator value signals problems only after high risk of the problem exists, but with few false alarms and mitigation measures are infrequently employed). If a significant risk of a problem occurring exists, mitigation measures may be needed immediately, not after the problem surfaces. The most cost effective mitigation measure at an early step of the drilling plan may not be effective later.

The last of the three, or a statistical risk analysis approach balances the cost and risk of the two aforementioned approaches, but requires costly sets of well failure and well success data to supply a statistical model. However, even this sophisticated probabilistic technique has not been able to reliably avoid the risks of failure or unnecessary mitigation measures in all cases even when sufficient data is available. Sufficient statistical data may also not be available for exploration wells.

A simplified analysis method is needed to allow the drilling of extended reach wells, without unnecessarily implementing costly problem mitigation measures or accepting unnecessary risk. The method should also not require extensive data.

SUMMARY OF THE INVENTION

The present invention provides an interactive modeling, planning, and indicator monitoring technique for drilling a well of interest that avoids unnecessary data gathering, needless mitigation procedures, and imprudent risks. Instead of statistical data set analysis or a single point prediction of each indicator (and basing drilling decisions on this single point prediction or a "normal" range around it), the well drilling variables are displaced or shifted within a physically feasible range to generate a plurality of predicted indicator values, each having a corresponding probability. If the predicted probability of any one value exceeding a threshold value is unacceptable, the drilling plan is modified. Critical variables are quickly identified by deleting those which do not significantly affect the indicator even after shifting. These can be safely ignored in future modeling, planning and monitoring. The early selection of economic mitigation measures which are directed to the critical variables is also accomplished, rather than a delayed or shotgun approach to selecting mitigation measures. The present invention is expected to be especially useful for severe or off-design drilling conditions, and in highly inclined boreholes.

BRIEF DESCRIPTION OF THE DRAWINGS

In these figures, it is to be understood that like reference numerals refer to like elements or features.

DETAILED DESCRIPTION OF THE INVENTION

Drilling an extended reach well increases drag forces on tubulars within the borehole. The drag forces create a risk of tubulars becoming stuck in the wellbore. The invention provides a risk analysis method to evaluate and mitigate excessive drag and other risks, especially for extended reach wells.

Figure 1:
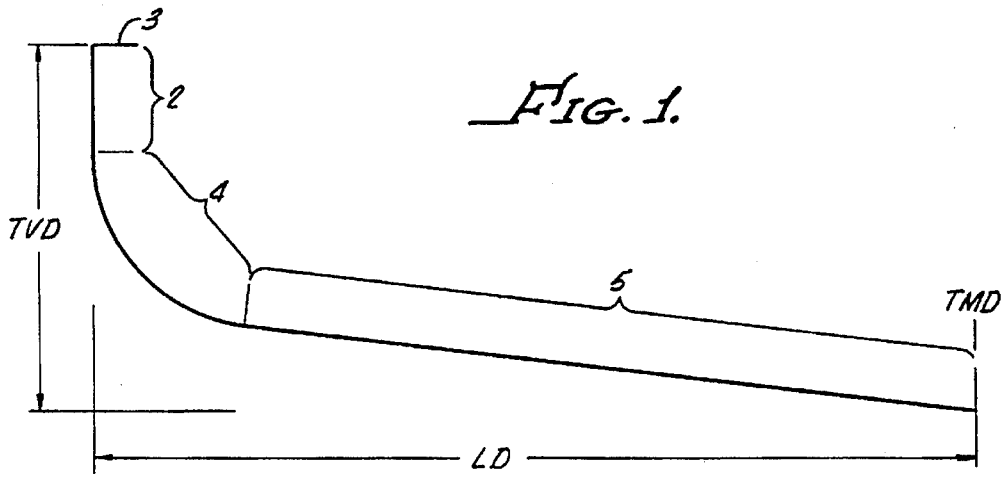
FIG. 1 shows a schematic representation of a sample subsurface well path.

FIG. 1 shows a schematic representation of a proposed subsurface well path of an extended reach well. As an example, the initial section 2 of the borehole below ground surface 3 is planned to have an axis nearly vertical for a measured and actual (vertical) depth of 243.8 meters (800 feet). The second or build section 4 changes the direction of the well. The incline angle θ (see FIG. 2) builds at a rate of approximately 3.5 degrees per 30.48 meters (100 feet) until a measured depth (distance from the ground surface as measured within the borehole) of 950.7 meters (3119 feet) is reached. A third or incline section 5 extends from a measured depth (i.e., length) of 950.7 meters (3119 feet) to the borehole bottom. The distance to the borehole bottom from the surface as measured within the borehole, or total measured depth ("TMD" as shown in FIG. 1) is planned to be 4032.2 meters (13229 feet). The actual total vertical depth ("TVD") and lateral displacement ("LD") is planned to be 1210 meters (3970 feet) and 3467.4 meters (11376 feet), respectively. The initial drilling plan is to drill and case the borehole to "TMD" with several different nominal diameter pipe strings. Other drilling variables in this example are listed in the following Table 1.

TABLE 1—EXAMPLE OF DRILLING VARIABLE VALUES FOR PROPOSED WELL

Incline angle of the deviated portion=81.17 degrees.

Drill string and bit: 31.1 cm (12¼ inch) nominal initial diameter followed by a 21.6 cm (8½ inch) nominal diameter.

Casing: 50.8 cm (20 inch) nominal diameter to 235.2 meters (775 feet), 34.0 cm (13⅜ inch) nominal diameter to a measured depth of 1829 meters (6000 feet), 24.4 cm (9⅝ inch) nominal diameter to 2956.6 meters, (9700 feet) and 17.8 cm (7 inch) nominal diameter to 4032.2 meters (13229 feet).

Expected feasible range of open hole friction factors: 44.5 cm (17½ inch) nominal string and bit in 44.5 cm (17½ inch) hole=0.30 to 0.80; 34.0 cm (13⅜ inch) nominal casing in 44.5 cm (17½ inch) hole=0.40–0.70; 31.1 cm (12¼ inch) nominal drill string and bit in 31.1 cm (12¼ inch) hole=0.25–0.70; 24.4 cm (9⅝ inch) nominal casing in 31.1 cm (12¼ inch) hole=0.35–0.60; 21.6 cm (8½ inch) nominal drill string and bit in 21.6 cm (8½ inch) hole=0.35–0.85; and 17.8 cm (7 inch) nominal casing in 21.6 cm (8½ inch) hole=0.30–0.80.

Measured inside casing friction factors: 31.1 cm (12¼ inch) nominal drill string and bit in 34.0 cm (13⅜ inch) nominal casing=0.2; 24.4 cm (9⅝ inch) nominal casing in 34.0 cm (13⅜ inch) nominal casing=0.33; 21.6 cm (8½ inch) nominal drill string and bit in 24.4 cm (9⅝ inch) nominal casing=0.31; and 17.8 cm (7 inch) nominal casing in 24.4 cm (9⅝ inch) nominal casing=0.35.

Figure 2:
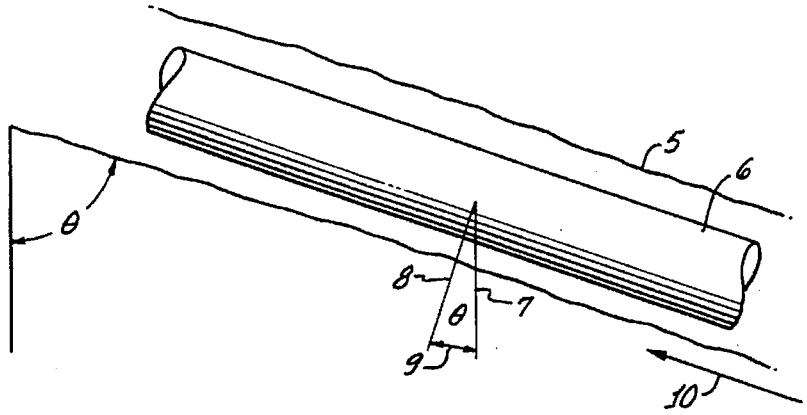
FIG. 2 shows the simple two dimensional forces on pipe string element in an inclined section of the well path shown in FIG. 1.

FIG. 2 shows the simple two dimensional forces on pipe string element 6 in the inclined borehole section 5 (see FIG. 1) at an incline angle θ to the vertical direction 7. Drag can become a severe problem during drilling and running casing into an extended reach well, especially if a well portion exceeds a critical drag angle. The critical drag angle defines an angle at which a pipe element or single pipe section will no longer slide down the hole by gravity, i.e., it must be forced or pushed down the hole to overcome drag forces. When a portion of the well path exceeds the critical angle over a long distance, enough drag will be generated to overcome the available weight of the non-critical angle path portions. When this happens, the pipe string (i.e., all pipe elements or sections) will no longer slide in the hole.

The buoyed weight of the pipe element 6 acts in the vertically down direction 7. The components of this weight are shown as a normal force 8 (i.e., perpendicular to the walls of the inclined section 5) and axial or transverse force 9. The axial force 9 tends to slide the element down the inclined borehole portion 5. However, the normal force component 8 of the weight also results in a drag force 10, which is a function of the normal (to the pipe direction) force and a working friction factor. As the incline angle θ increases towards 90°, the normal force component 8 increases and the axial force component 9 decreases. For a certain friction factor and incline angle, i.e., the critical incline angle, the friction factor times the normal force (i.e., drag force 10) is equal to the axial force 9. For a friction factor of 0.2, the critical angle is 78.7 degrees. Similarly, for a friction factor of 0.3, 0.4 and 0.5, the critical incline angles are 73.3, 68.2, and 63.4 degrees respectively.

Figure 3:
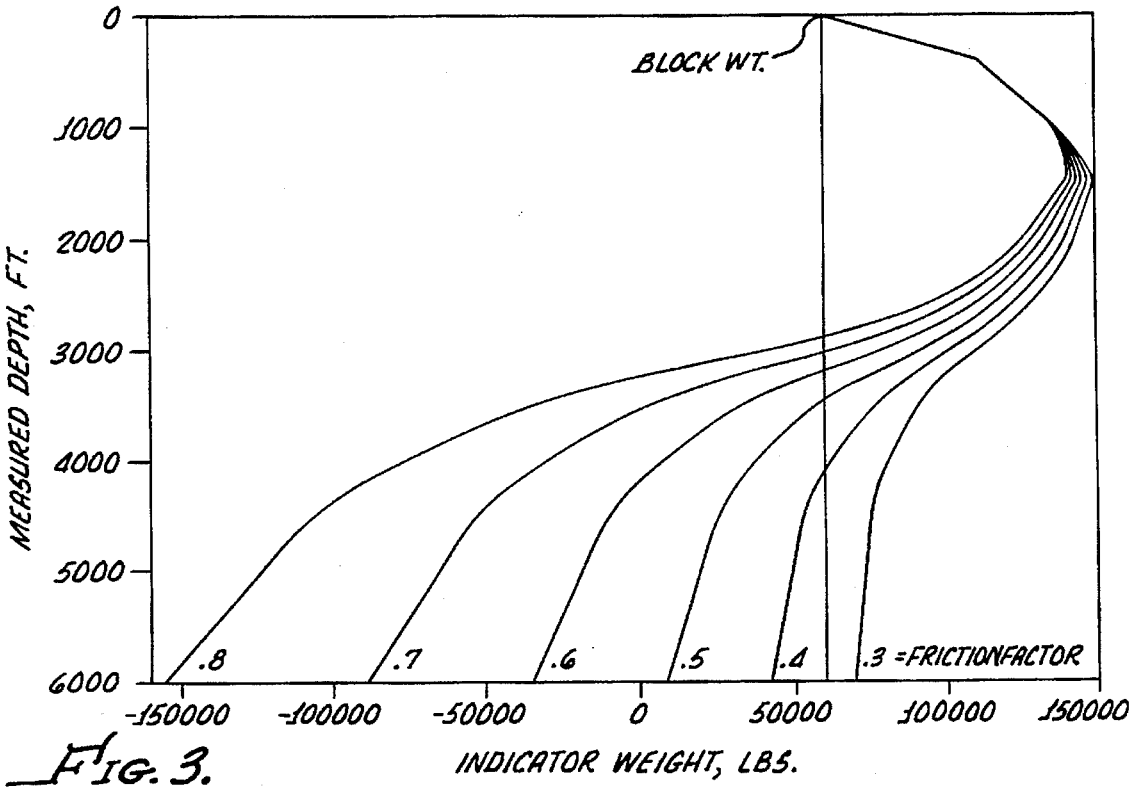
FIG. 3 is a graph of slack off weights calculated from perturbed friction factors for a portion of the well path shown in FIG. 1.

FIG. 3 shows an example of using the preferred embodiment method to calculate predicted decrease in supported or indicator weight during slack-off periods of the planned non-rotary running or tripping of a nominal 17½ inch hole portion of the well path (shown in FIG. 1). The indicator weight is generally the weight of the drill rig supported drill string and drilling equipment (e.g., block weight plus assembled tubular section weights) less any upward forces, such as buoyant and drag forces on the tubulars within the borehole. The block weight (i.e., the initial supported weight without tubulars) can also be the desired minimum weight for control of the supported weight drilling apparatus.

The borehole portion extends to a "measured depth" of 6000 feet. Since the working "friction factor" is uncertain but feasibly ranging from 0.3 to 0.8 as shown in Table 1, a series of supported weight (i.e., condition indicator) predictions are plotted as shown in FIG. 3. Since nearly all the feasible friction factors result in lack of sliding (i.e., incline angle is above the critical incline angle θ), even if lower friction factor mitigation measures are implemented and lower friction factors are likely, operation will require added loads to force the drill string down the highly deviated borehole. The indicator loads required for nearly every shifted value within the feasible friction factor range show a high likelihood of stuck pipe string and other problems if the initial drilling plan is implemented, indicating added load is needed.

A low cost mitigation option of using a heavier weight drill string (in the up-hole portion 2 as shown in FIG. 1) to add load as interactively selected. A drilling plan with this mitigation option is now modeled and analyzed similar to the initial drilling plan. This second model and shifted analysis can determine if an acceptable likelihood of success is achieved or whether additional mitigation measures are needed.

Figure 4:
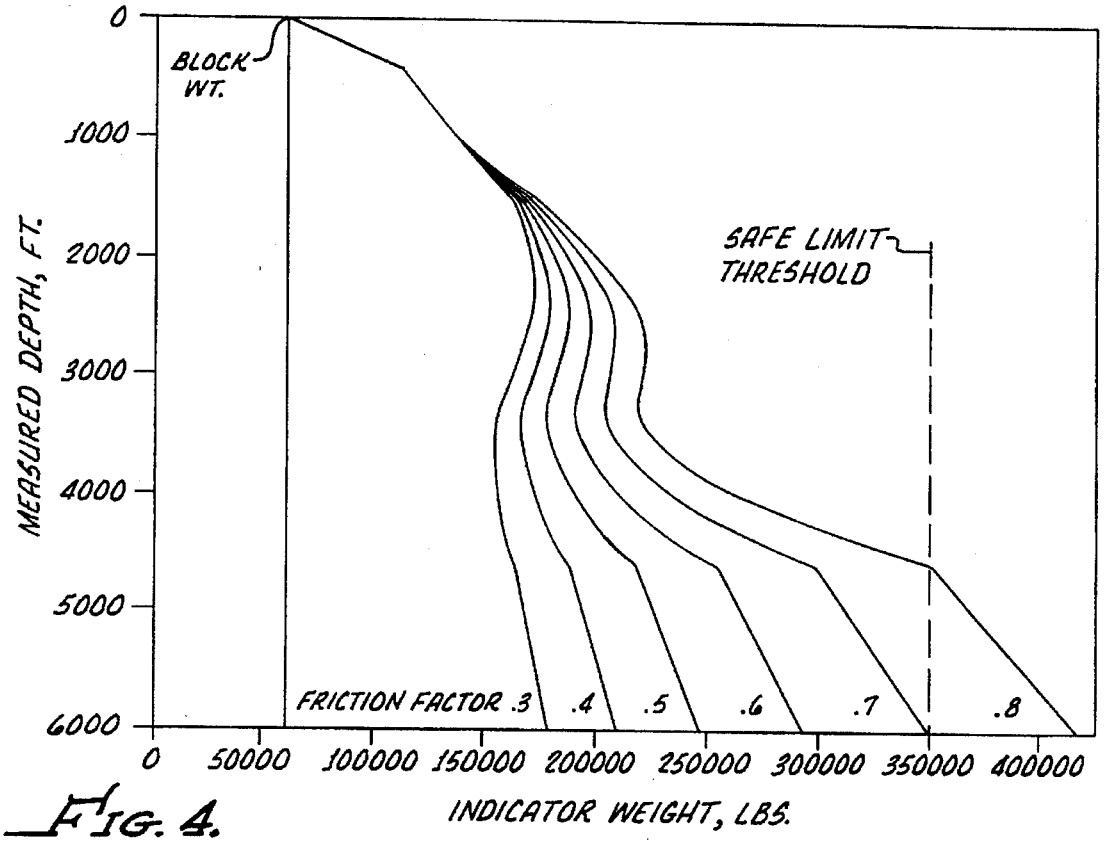
FIG. 4 shows a graph of pick up weights calculated from perturbed friction factors when using heavier drill pipe up hole in the well path shown in FIG. 1.

FIG. 4 shows a graphical presentation of a second analysis of indicator weights during pick up operations after modification (added weight) of the drilling plan. A heavier drill pipe up hole (e.g., thicker wall drill pipe in at least the vertical portion of the borehole) in the near vertical well path portion (shown in FIG. 1) is now planned to assist running but the added weight may adversely affect pick up operations. The expected friction factor is again incrementally shifted for the analysis.

Because of the pipe working limit, a drilling rig can pull a maximum of 1,556,800N (350,000 pounds) on the supported pipe. The (now added weight) drilling plan to drill an extended reach borehole in the shape similar to FIG. 1 is analyzed to verify that the increased weight will not exceed the pipe working limit of the casing in the drill rig. FIG. 4 shows the pre-calculated forces needed during pick-up operations to remove the heavier drill string at various depths with assumed friction factors.

The graph of shifted friction factors in FIG. 4 shows that safe or threshold drilling rig/pipe limitations (lifting capability threshold) is exceeded at bottom pick up if the friction factor exceeds 0.7. Although not probable, a friction factor of 0.7 or 0.8 is expected not more than 20 percent of the time, and probably no more than 10 percent of the time.

The estimated likelihood is not trivial. In addition to the direct cost effects of the high lifting loads and drill rig/pipe limitation problems, the loads are also related to the likelihood of other problems or unwanted conditions (e.g., stuck drill string, otherwise damaged drill string, and delay/inability to change drilling rigs). Specifically, as shown in FIG. 4, the high friction factors in excess of 0.7 result in being unable to safely pick up the now heavier drill string at or near bottom unless a larger capacity rig/pipe having a higher pipe working limit is used.

There are essentially three options when faced with these less than likely, but not insignificant probability analysis results. The first option is to drill and accept the 10 to 20 percent risk without any changes or specific monitoring plans during the drilling. For example, if the risk is small enough and multiple wells are planned, a larger capacity rig with higher working limit pipe is readily available, and/or shallow wells are also needed, this take the risk option may be acceptable.

A second option is to drill and specifically monitor (pick-up) indicator weight. Actual monitored weight is compared at various depths to friction factor curves shown in FIG. 4 and the closest curve is determined. If the monitored (actual) indicator weight values are close to a curve show a friction factor of 0.7 or greater, the drilling plan would be modified during drilling, such as decreasing the incline angle. The second approach reduces the risk, the reduction related to how effectively and early the monitored indicator can show impending risk of the unwanted condition and how effective mitigation measures are when implemented after drilling has started.

If not willing to accept even a reduced risk, the third option is to modify the planned drilling process before drilling to still further reduce the risk. For example, a lubricant drilling mud or a flotation device, as shown in copending U.S. patent application Ser. No. 07/401,086 filed on Aug. 31, 1989, now U.S. Pat. No. 5,986,361 herein incorporated by reference in its entirety, can be used to reduce or even eliminate drag on the tubular components in the deviated portion of the borehole.

In this example, option three was chosen. That is, the unlikely, but significant probability of major problems even if indicator weight is monitored (estimated as no more than 10 percent in this example) combined with the large cost impacts if this unlikely friction factor occurred was deemed unacceptable, and a further modified drilling plan was required.

Use of hole conditioning and lubrication methods as further mitigation measures were chosen. These further planned mitigation measures significantly reduce the likelihood of a friction factor exceeding 0.7. The shifting analysis process was again repeated with planned heavier weight string in a lubricated/conditioned borehole. This reduced the predicted probability of a 0.7 friction factor to an acceptable level, especially if indicator weights were monitored during drilling (i.e., option 2). If the actual (monitored) indicator weights approach or exceed the predicted pick up or slack-off values calculated for a friction factor of 0.7 early in the actual drilling operation, additional conditioning and/or lubrication mitigation measures can be now be taken quickly to further reduce the friction factor or otherwise reduce the likelihood of problems.

Figure 5:
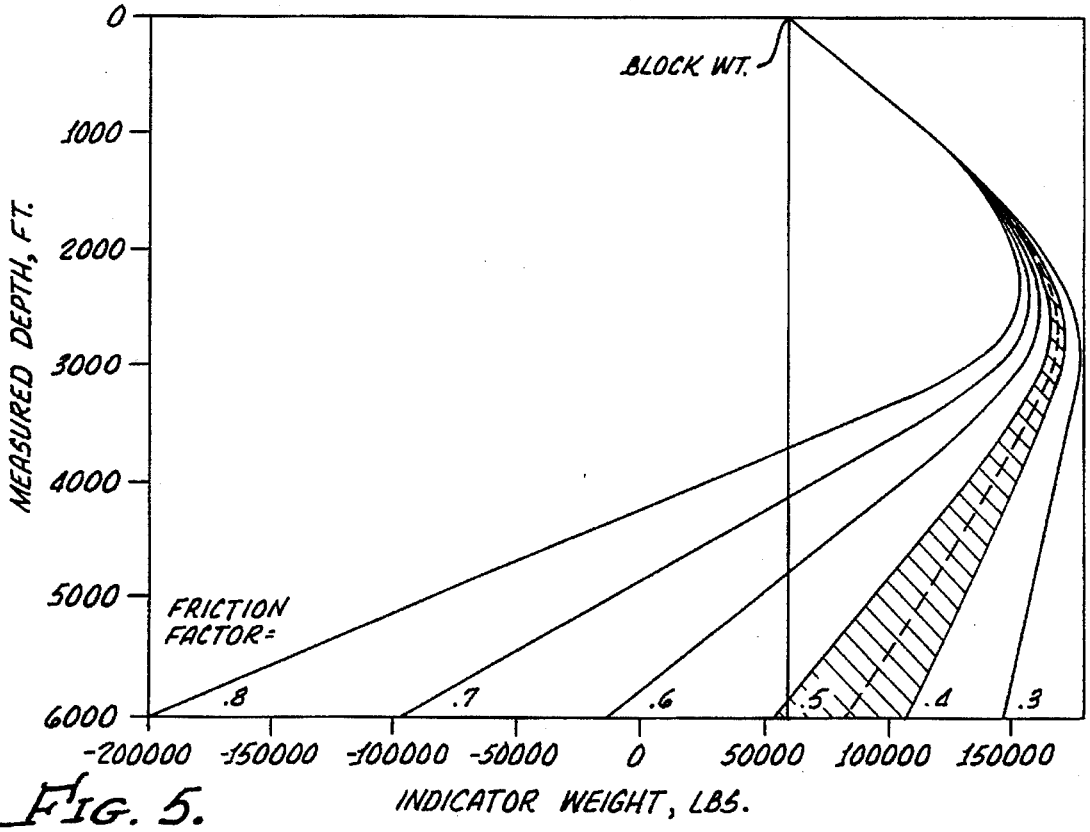
FIG. 5 shows a graph of feasibly possible slack off weights when running casing in a portion of the well path shown in FIG. 1.

FIG. 5 shows a graph of predicted and feasibly possible decrease in indicator (in this case, during slack off operations) weights from the initial block weight during the doubly mitigated (heavy weight and lubricated/conditioned hole drilling) plan for running the 34.0 cm (13⅜ inch) nominal casing in a portion of the well path. The most likely or predicted average slack off supported (indicator) weight as a function of depth and the average expected friction factor of 0.45 is shown as a dotted curve. The expected or "normal" friction factor now lies within a narrow range of 0.4 to 0.5, shown hatched in FIG. 5, now only having a small likelihood of being near or above 0.5. After calculations, a small, but now acceptable likelihood of problems (if monitored during drilling) near the bottom exists for friction factor values near 0.5. Monitoring and comparing operating indicator weight to the predicted range of feasible curves is expected to be able to detect potential problems early, allowing cost effective further mitigation measures to be implemented early if the operating friction factor approaches 0.5. In addition, actual friction factor (calculated from data taken during drilling) of the 44.5 cm (17½ inch) borehole drilling may also be used to modify likelihoods and expected values of other friction factors, allowing additional time to implement necessary mitigation measures. Similar graphs of indicators under various feasible friction factor conditions can be made for each casing and drilling operation. For the planned drilling, other mitigation measures can also be implemented before the adverse results of another unlikely drilling variable or indicator show an unacceptable risk.

Another possible mitigation measure, especially applicable to extended reach wells, is to increase the buoyancy forces on the tubulars in the deviated well portions, as shown in copending U.S. application Ser. No. 07/401,086 filed Aug. 31, 1989 now U.S. Pat. No. 4,986,361 herein incorporated by reference in its entirety. If this mitigation measure is selected, another shifted analysis is recommended.

The likelihood of a given friction factor is dependent upon many drilling variables, as previously discussed, but individual drilling variables are not always required. If sufficient data exist, the likelihood of the indicator(s) can be judged directly in this preferred embodiment of the method. Alternative assessments/computation of the likelihood of the indicator (or drilling variable) can be based upon prior well drilling variable data in the same area, similar wells in similar geologic formations or a calculation based on the generally assumed significant drilling variables which influence the indicator(s). This alternative assessment can also be a combination of the statistical analysis approach of U.S. Pat. No. 4,791,998 (previously discussed) and the probabilistic shifted calculations and interactive drilling plan modification process of the present invention.

One type of calculation of a drilling variable, such as a working friction factor, is a summation of drilling variable factors. Working friction factor is an empirical factor which encompasses many individual contributors. The individual contributors, such as "true friction" factor, key seat factor, ledge factor, cuttings bed factor, bit balling factor, and differential sticking factor, are combined to calculate the total or working friction factor. Each of these drilling working friction contributors are variables that are generally uncertain, but can be bounded within a feasible range by using theoretical and/or empirical analysis and related to indicator weight.

The significant or critical drilling variables which are related to the working friction factor for a specific well configuration can be determined by shifting or otherwise perturbing each drilling variable within its physically feasible range. If the working friction factor and/or problem indicators are not significantly affected over the feasible range of the drilling variable, the variable can be fixed or ignored in later shifted friction factor and supported weight indicator calculations, monitoring, etc. The most critical variables can also be determined as the ones having the largest effects on the working friction factor or problem indicators. Low cost mitigation measures which influence these critical variables should be considered first if an unacceptably high likelihood of an unwanted condition resulting from a high friction factor is calculated.

Figure 6:
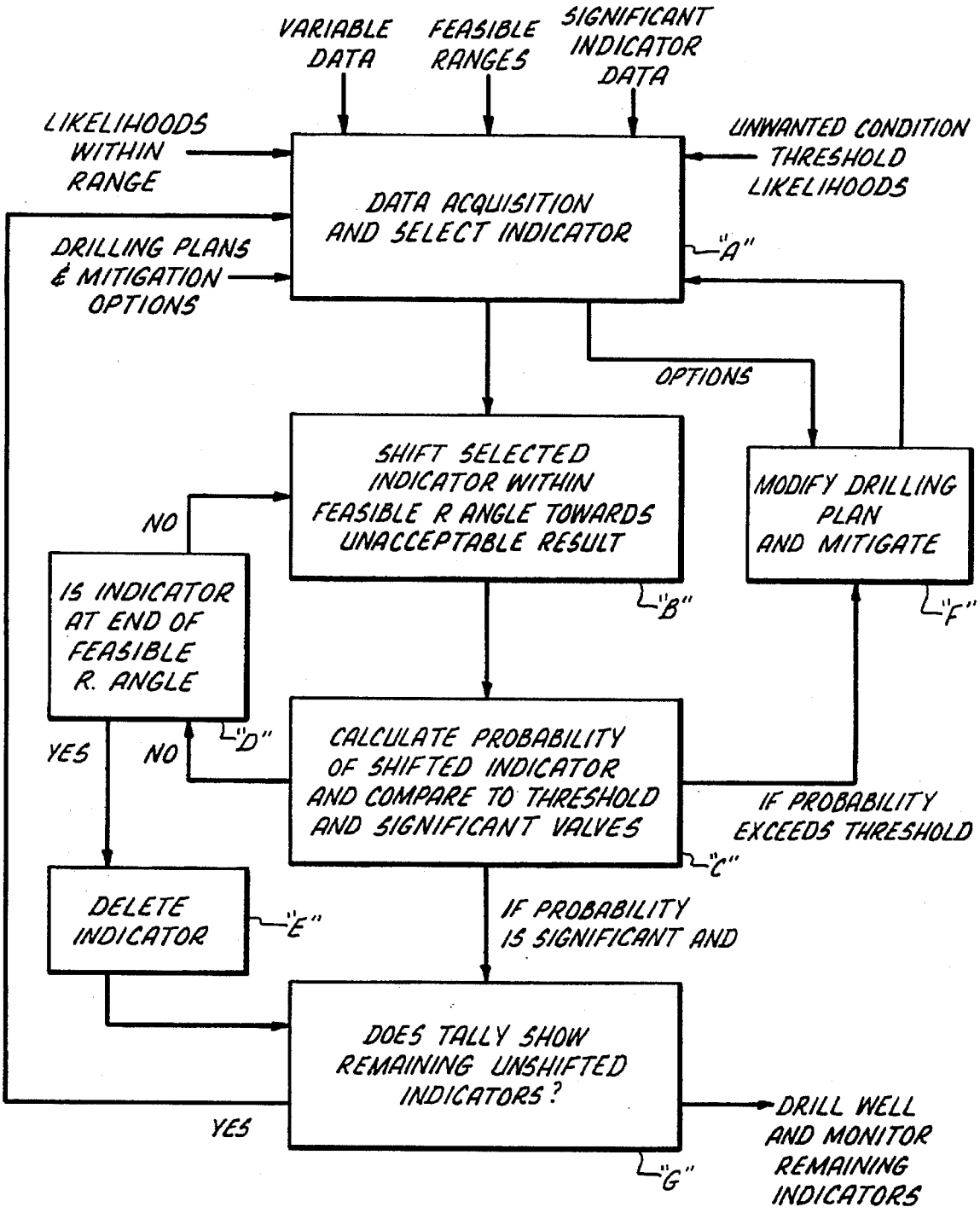
FIG. 6 is a block diagram of a process and an apparatus to accomplish the process steps.

A block diagram of the process steps and the apparatus to accomplish an embodiment of this method are shown in FIG. 6. A data acquisition module "A" is in electrical communication with transducers or other input devices. Drilling plan data, unwanted condition mitigation options, relationships between variables and indicators, initially expected values of indicators, drilling variables, the physically feasible ranges of variables and indicators (if available), level of significance of variables and indicators, and indicator likelihood thresholds are supplied to the Module "A." The module apparatus is typically a digitizing device and microprocessor, but may also include a manual keyboard data entry device. "Normal" or initially expected values of the indicators are calculated from the drilling plan and expected drilling variables, unless input directly. Alternatively, any feasible prediction of the indicators can be used initially. The module may also calculate initial indicators from prior average drilling variables or from default values if specific other inputs are not supplied.

An expected variable (which also may be an indicator) is selected if tally shows it was not previously chosen and communicated to Module "B" where it is to be changed or shifted based upon data supplied to Module "A." The shift may be a plurality of shifts in increments over (but generally within) the feasible range input to or calculated by Module "A" from supplied data. A shift towards an increased likelihood of an unwanted or unacceptable result/indicator is the preferred direction of shifting. If the direction of shift towards an unacceptable result is not clear, shifts to both ends of the feasible range are accomplished.

Module "B" apparatus may be part of the Module "A" microprocessor, or Module "B" can be a separate calculating means. A tally of selected indicators or variables is also maintained by Module "B" apparatus and transmitted to subsequent modules.

The incrementally shifted values from Module "B" are communicated to Module "C" where the probability of each shifted value of the selected or calculated indicator is determined. For example, the probability of an indicator weight at a given depth is dependent upon the probability of the shifted friction factor and other drilling plan variables and factors (input to Module "A"). The calculations of Module "C" use the shifted values (accomplished by Module "B") and the probability distributions of drilling variables or other factors input into Module "A" to calculate the probability of selected and shafted indicators of problems or unacceptable drilling results.

Module "C" also compares the probability of the selected shifted indicator to the indicator's threshold and significance values derived from Module "A." Apparatus for comparing at Module "C" may be a separate matrix or comparator, but may also be a part of the aforementioned microprocessor of Module "A." If the comparison shows a probability not exceeding the significance level calculated or input supplied by Module "A" (i.e, a trivial effect), the indicator is deleted in Module "E." If tally shows remaining un-shifted indicators, another indicator or drilling variable to be shifted is selected in Module "A" until all significant indicators and variables are analyzed. If an indicator is not at the end of the worst case range in Module "D," a further shift (another increment of shift) in the indicator/drilling variable is implemented in Module "B" until indicator is at the worst end of the feasible range.

If the unwanted condition indicator probability exceeds an acceptable likelihood in Module "C", a mitigation option is chosen at Module "F." Module "F" choosing may be accomplished manually (i.e., interactive mode) or a pre-planned series of drilling mitigation measures can be planned and input into Module "A." The modified drilling plan, derived from Module "A," is supplied to Module "B," the chosen indicator tally is reset to zero, and the process is repeated until the shifted indicator probability does not exceed the threshold.

If the calculated probability of shifted indicator or variable shows significant changes to the likelihood of an unwanted condition but below the threshold value, the selected variable (or indicator) is transmitted to Module "G." If other non-shifted indicators remain, the process starting at Module "A" is repeated. Again, Modules "D," "E," "F," and "G" may be part of a general microprocessor or separate comparators/information processing devices.

If no other indicators remain, drilling is carried out while monitoring the remaining indicators and variables. Monitored data are now supplied to Module "A" and the information processing/drill plan changing continues as previously discussed. Some of the indicators, drilling variables, and drilling plan options may be zeroed or removed from consideration during the drilling if no longer feasible or significant to the probability of an unwanted result. For example, heavier weight tubulars may not be an economic option when nearing bottom hole.

If mitigation options are not preselected, selection of remaining mitigation options in Module "F" is analyzed similar to aforesaid risk analysis steps based upon input expected (and probabilities of) effects upon indicators or variables. Comparison of remaining significant indicator/variables to the expected effect of each option on these values is accomplished in Module "F." The mitigation options can also be selected and tested (analyzed) in order of increasing cost.

The invention allows optimum drilling plans and operations during exploration, production, logging, work-over, or shut-in activities. Unnecessary indicators or variables (e.g., variables which even at worst case do not introduce more than an insignificant level of risk) can be safely ignored when sufficient data or analysis allow it and more cost effective drilling/monitoring can be implemented.

Although the aforementioned discussion assumes independent indicators and drilling variables, dependent variations can also be accommodated if the dependent relationship is known, such as friction factor dependent upon drilling fluid composition, rotation speed, or depth variables. Inputting these relationships into Module "A" and shifting of one indicator/variable at Module "B" therefore simultaneously shifts dependent indicators/variables. Subsequent determinations and comparisons take into account the effects of both the shifted independent and shifted dependent variables and indicators.

Still other alternative embodiments are possible. These include: a plurality of interconnected microprocessors; incorporating a heuristic (i.e., self learning) algorithm to determine range, increments and likeliness values during repeated usage; significance and threshold values in Module "A" can be altered during drilling based on variable drilling and other input data; replacing microprocessor steps with manual calculations; and locating the microprocessor downhole within a protective enclosure. The apparatus and process can also be applied to excavation, tunneling, remotely controlled underwater construction or other applications having multiple variables/indicators and where significant uncertainty exists. For example, the risk of slides during excavation is related to wall slope geometry, compaction strength, and other variables. The method would input these relationships and initial values, shift these values within expected ranges, isolate significance and variables, compare results to threshold values, and interactively select slide mitigation measures to produce a low risk and cost effective excavation.

Methods of accomplishing drilling and completion of extended reach wells are also disclosed in paper entitled "Extended Reach Drilling From Platform Irene," by M. D. Mueller, J. M. Quintana, and M. J. Bunyak, presented to the 22 Annual Offshore Technology Conference in Houston, Tex., May 7–10, 1990, the teachings of which are incorporated herein by reference.

While the preferred embodiment of the invention (method to predict and monitor supported weight in highly deviated holes) has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. A method of controlling the likelihood to a probability limit of a pipe string becoming stuck during a subsurface drilling process, the method using predicted supported weight of the pipe string as one indicator of becoming stuck if the indicator exceeds a threshold value, wherein the supported weight is dependent upon an uncertain friction factor having a probability distribution within a physically feasible range, which method comprises:

a. rotary drilling a first portion of a subsurface cavity using a drilling process;

b. selecting a predicted friction factor value and calculating a predicted value of supported weight during a portion of the drilling process, the predicted value of supported weight based at least in part upon the predicted friction factor value;

c. changing the selected friction factor value within a physically feasible range and calculating a changed value of supported weight based at least in part upon the changed friction factor;

d. comparing the changed value of supported weight to the threshold value;

e. if the changed value of supported weight is greater than the threshold value, computing a risk probability value of the changed supported weight being greater than the threshold based at least in part upon the probability of the changed friction factor; and f. if the risk probability value exceeds the probability limit, drilling a portion of said cavity using a drilling process that reduces said computed risk probability value.

2. A method of controlling the likelihood of a condition to a probability limit during a portion of a construction process subsequent to a first portion, said method using at least one value of an indicator of a possibility of said condition when said indicator value exceeds a threshold value, wherein said indicator value is uncertain and has a no-zero probability within a range of indicator values, which method comprises:

a. constructing said first portion;

b. obtaining at least one indicator value at least in part representative of one factor which may affect said condition during said subsequent process portion;

c. changing said indicator value to a first changed indicator value within a said range of indicator values;

d. comparing said first changed indicator value to said threshold value;

e. if said first changed indicator exceeds said threshold value, computing a first probability of said changed indicator value based at least in part upon said non-zero probability of said indicator value; and f. if said first probability exceeds said probability limit, constructing said subsequent process portion using a modified construction process and repeating steps b through e.

3. The method of claim 2 wherein said condition is unwanted and said changing of said first changed indicator value is towards one end of said feasible range having a higher likelihood of said condition occurring.

4. The method of claim 3 wherein said subsequent portion is drilling a borehole and said obtaining said indicator value step comprises the steps of:

obtaining at least one initial drilling variable value representative of a physical factor which may affect said unwanted condition; and calculating said one indicator value at least in part based upon said one of said initial well drilling variable values.

5. The method of claim 4 wherein said changing step comprises:

first changing the value of said at least one variable value within a physically feasible range for said variable, said first changed variable value being closer to one end of said feasible range of said variable than said initial variable value, wherein said first changed variable value represents a non-trivial likelihood of occurring; and calculating a first changed indicator value based at least in part upon said first changed variable value.

6. The method of claim 5 which also comprises:

g. second changing the value of said at least one well drilling variable generally within said physically feasible range, said second changed value having a non-trivial likelihood of occurring and being more distant from said one end of said feasible range than said initial value and said first changed value;

h. calculating a second changed indicator value;

i. computing a second probability value of said second changed indicator value based at least in part upon said second changed variable value;

j. if said second probability value exceeds said probability limit, modifying said drilling; and k. repeating steps b through j using said modified drilling variables until said probability value does not exceed said probability limit.

7. The method of claim 6 wherein said method uses a level of significance value of changes to said indicator, said method also comprising the steps of:

l. calculating an incremental indicator value based upon the difference between said first changed indicator value and said predicted indicator value;

m. comparing said incremental indicator value to said level of significance value; and n. if said compared incremental indicator value equals or exceeds said significance value, repeating steps b. through m.

o. if said compared incremental indicator value does not exceed said significance value, deleting said indicator and repeating steps b through j using another indicator.

8. The method of claim 7 wherein said deleting step is accomplished only after said indicator has been changed over most of its entire feasible range.

9. The method of claim 8 wherein a portion of said borehole is drilled at an inclined angle, said drilling variable is a friction factor, said indicator is a plurality of supported weight values dependent upon a drilling depth, and said unwanted condition is a stuck drill string, which also comprises the steps of:

p. monitoring said actual supported weight values during said drilling;

q. calculating a revised friction factor which would cause said actual supported weight values to approach said unwanted condition; and r. revising said predictions based upon said revised friction factor.

10. The method of claim 9 wherein said friction factor is composed of several drag related factors and each of said drag related factors affect a plurality of dependent indicators, wherein said method also comprises the steps of:

s. changing at least one of said drag related factors; and t. calculating a changed value of one of said dependent indicators based at least in part upon said changed drag related factors.

11. The method of claim 10 which also comprises the steps of:

u. heuristically determining the increment of said change of at least one of said indicators; and v. heuristically determining the feasible range of at least one of said indicators.

12. A method of excavating to limit the likelihood of an unwanted excavating result, the method using a threshold value of an unwanted result indicator dependent upon an uncertain factor having a probability distribution within a physically feasible range, which method comprises:

a. selecting a likely factor value within said range and calculating a first predicted indicator value during a subsequent portion of the excavating method based at least in part upon said likely factor value;

b. selecting an unlikely factor value having a likelihood less than said likely factor value within said range and calculating an unlikely predicted indicator value based at least in part upon said unlikely factor value;

c. comparing said unlikely predicted indicator value to said threshold value;

d. if the unlikely predicted value is greater than the threshold value, computing a risk probability value of the changed supported weight being greater than the threshold based at least in part upon the probability of the changed friction factor; and e. if the risk probability value exceeds the probability limit, excavating so as to reduce said computed risk probability value and repeating steps a through d.

13. A method of preventing an unacceptable likelihood value of a result during an underground well construction process, said method using calculated indicator values of an indicator related at least in part to said result and a threshold indicator value having a minimum acceptable likelihood of said result, wherein said indicator values are dependent at least in part upon a factor value of an uncertain factor having a likelihood at least equal to a minimum likelihood within a range of factor values, which method comprises:

a. preparing equipment to construct a portion of said well using a first construction process;

b. calculating a first indicator value based upon a first factor value within said range;

c. obtaining a second indicator value based upon a second factor value not equal to said first factor value and within said range;

d. comparing said second indicator value to said threshold value;

e. if said second indicator value exceeds said threshold value, computing an indicator likelihood value based at least in part upon said second factor value likelihood;

f. comparing said indicator likelihood value to said acceptable likelihood value; and g. if said indicator likelihood value is at least about said unacceptable likelihood value, constructing said well using a second process different from said first process.

14. The method of claim 13 wherein said process is a drilling process using a supported tubular weight apparatus for drilling a borehole including completion by running and setting tubulars in said borehole and wherein said modified process reduces the probability said indicator likelihood value is at least about said unacceptable likelihood value.

15. The method of claim 14 wherein said borehole includes non-vertical portions and wherein said modified process increases the buoyant forces on said tubulars.

16. The method of claim 15 which also comprises:

h. summing indicator likelihood values in excess of said unacceptable likelihood value; and i. further modifying said drilling process based upon said summation.

17. The method of claim 16 wherein said indicator is related to the supported weight of said tubulars.

18. The method of claim 17 wherein said factor is related to the total friction factor experienced by said tubulars during said running.

19. The method of claim 18 wherein said threshold value is the maximum supported weight of said drilling apparatus.

20. A method of preventing an unacceptable likelihood value of exceeding a result limit during a construction process using an uncertain indicator related at least in part to said result and dependent at least in part upon an uncertain factor, which method comprises:

a. preparing to accomplish said construction process such that a first value of said uncertain indicator is most likely;

b. selecting a threshold indicator value indicating an acceptable result limit is not exceeded;

c. obtaining a likelihood of a first factor value of said uncertain factor within a range of values;

d. calculating a plurality of said indicator values during said process based at least in part upon said first factor value;

e. comparing said calculated indicator values to said threshold value;

f. if either one of said calculated indicator values is more than about equal to said threshold value or not one of said calculated indicator values are at least about equal to said threshold value, obtaining a likelihood of a subsequent factor value of said uncertain factor within said range and not about equal to said first factor value and replacing said first factor value with said subsequent factor value;

g. repeating steps d–g until said calculated indicator values are either no more than about equal to said threshold value or no other value of said uncertain factor within said range is expected to produce calculated indicator values about equal to said threshold value;

h. computing an indicator threshold likelihood value based at least in part upon said first factor value likelihood if said calculated indicator values are at least, but no more than about equal to said threshold value;

i. comparing said indicator threshold likelihood value to said unacceptable likelihood value; and j. if said indicator likelihood value is at least about said unacceptable likelihood value, accomplishing said physical construction process such that a modified value of said uncertain indicator is most likely.

21. The method of claim 20 which also comprises the step of:

k. if said indicator likelihood value is greater than said unacceptable likelihood value, repeating steps b–i until said indicator value is less than about said unacceptable likelihood value.

22. The method of claim 21 which also comprises the steps of;

l. monitoring said indicator during said modified process if said indicator value is about equal to said unacceptable likelihood value;

m. if the monitored values of said indicator during said modified process are comparable to said calculated values, further modifying said process.

* * * * *